US008651697B2

(12) United States Patent
Wollak et al.

(10) Patent No.: US 8,651,697 B2
(45) Date of Patent: Feb. 18, 2014

(54) LIGHTING SYSTEM WITH FRONT ACCESS TO LIGHT SOURCE

(75) Inventors: Evan D. Wollak, Lombard, IL (US); Ricardo A Ramirez, Cicero, IL (US); Clayton P Spanjer, Northfield, IL (US)

(73) Assignee: Icon Identity Solutions, Elk Grove Village, IL (US)

( * ) Notice: Subject to any disclaimer, the term of this patent is extended or adjusted under 35 U.S.C. 154(b) by 284 days.

(21) Appl. No.: 13/231,960

(22) Filed: Sep. 14, 2011

(65) Prior Publication Data

US 2013/0063936 A1 Mar. 14, 2013

(51) Int. Cl.
*F21V 11/00* (2006.01)

(52) U.S. Cl.
USPC ..... 362/249.02; 362/97.3; 362/147

(58) Field of Classification Search
None
See application file for complete search history.

(56) References Cited

U.S. PATENT DOCUMENTS

| | | | | |
|---|---|---|---|---|
| 8,465,174 | B2 * | 6/2013 | Ing et al. | 362/249.01 |
| 2002/0000057 | A1 * | 1/2002 | Nash | 40/564 |
| 2009/0296422 | A1 * | 12/2009 | Lee et al. | 362/558 |
| 2013/0039034 | A1 * | 2/2013 | Baer et al. | 362/95 |

OTHER PUBLICATIONS

"SmartPanel," Insight Lighting, www.insightlighting.com, Aug. 16, 2010, published in the United States.
"SmartWall," Insight Lighting, www.insightlighting.com, Aug. 16, 2010, published in the United States.

* cited by examiner

*Primary Examiner* — Ashok Patel

(57) ABSTRACT

Disclosed is a lighting system and a method to change the internal light source of the lighting system, wherein maintenance and aesthetic considerations make it necessary to access the internal light source solely from the front of the lighting system without moving or removing a sign face. Access, in part, is provided by a light baffle track system inside the light system that turns a flexible light baffle (i.e., the light source) within the service box from a substantially vertical orientation to a substantially horizontal orientation as the flexible light baffle is removed and reinstalled through the service box and front access door. The flexible light baffle and light baffle track system work in concert to efficiently turn the flexible light baffle solely within the service box such that the height and depth of the service box is minimized.

20 Claims, 9 Drawing Sheets

LIGHTING SYSTEM WITH FRONT ACCESS TO LIGHT SOURCE

BACKGROUND

Lighting systems are commonly used in commercial, industrial, communal, and residential settings. Lighting systems generally comprise a housing, an interior light source, a power supply, and a sign face. Lighting systems serve a wide variety of purposes. For example, they may be used as primary signage on the outside of a location. Examples of primary signage are pylons, monuments, wall cabinets, multi-tenant sign panels, letters, soffit bands, canopies, and buildings, surrounds, towers, and toppers of automated telling machines ("ATM"). Secondary signage, such as directional signs, regulatory signs, plaques, lane indicators, and open/close signs, are smaller and generally found throughout a location. Interior signage, as its name suggests, is found in the inside of a location. Examples of interior signage are interior mall signs, customer contact zone signs, digital portraits, wall coverings, vinyl displays, vestibules, teller area, cubicle panels, office signs, hanging window posters, online & telephone kiosks, directional signs, and welcome signs.

One issue with maintaining a lighting system is accessing the interior light source of the lighting system when the top, bottom, sides, and rear of the lighting system are substantially or entirely restricted, and moving or removing the sign face of the lighting system would be cost prohibitive, time consuming, highly impractical, or otherwise undesirable.

By way of example, traditional full wall mounted lighting systems require rear doors or panels to access its interior light source. The ceiling, floor, and adjacent walls of a room, for example, restrict access to the top, bottom, and sides of the full wall mounted lighting system. The front is restricted by fixed sign faces made of glass or plastic. Fixed sign faces are attached by means of channel extrusions or mullions, because other means of attachment such as screws or bolts are undesirable and aesthetically displeasing. Removing and reinstalling fixed sign faces require specialized workers, specialized tools, a significant time commitment, and, in some cases, governmental work permits. The costly and time consuming process requires specialized workers known as glazers to remove sign faces from the extrusions or mullions using specialized tools such as suction cup grips; separate maintenance personnel to service the interior light source; and glazers to reinstall the sign faces into the extrusions or mullions and, for example, re-caulks seems.

Accordingly, full wall mounted lighting systems require access to rear doors or panels of the lighting system to service the light source. Because access to rear doors or panels is generally provided through an adjacent room, full wall mounted lighting systems are not installed on exterior walls, walls adjacent to other tenants, or existing walls made, for example, of concrete, granite, concrete masonry unit ("CMU"), or brick.

SUMMARY

The present invention is defined by the claims, and nothing in this section should be taken as a limitation on those claims.

By way of introduction, the embodiments described below provide a lighting system and a method to change the interior light source of the lighting system, wherein maintenance, aesthetic, and practical considerations make it necessary to access the interior light source solely from the front of the lighting system without moving or removing the sign face.

In one embodiment, a branding wall is created by incorporating a mounted lighting system into a non-illuminated wall. The lighting system is comprised of an inconspicuous service box connected to the top, bottom, or side of a light box. A service door is connected to the service box. In a preferred embodiment, the service box and service door are hingedly connected. The service door opens away from the front of the lighting system. In its closed position, the service door appears ornamental with little to no evidence of hinges, handles, screws, or other devices that would suggest the service door's functionality.

The light box is open to the service box. The front of the service box appears substantially flush with the front of the light box, which in return is substantially flush with the front of the non-illuminated wall creating a substantially flat branding wall. At closer inspection, the sign face is slightly recessed into the light box. Accordingly, the non-illuminated wall encompasses the lighting system.

The light box comprises a removable, interior light source and a transparent or semi-transparent sign face. Access to the light source is limited solely to the front of the lighting system because the non-illuminated wall, or other obstruction, prohibits access to the top, bottom, and sides of the lighting system. Rear access is also prohibited by, for example, exterior walls, walls adjacent to other tenants, or existing walls made, for example, of concrete, granite, CMU, or brick. In addition, the size, shape, weight, or other consideration related to the sign face makes moving or removing it cost prohibitive, time consuming, and impractical. For example, moving or removing the sign face may require specialized workers, specialized tools, a significant time commitment, and, in some cases, governmental work permits. Therefore, the interior light source must be accessed solely from the front of the lighting system without moving or removing the sign face of the lighting system.

The light box also comprises a flexible light baffle. The flexible light baffle is comprised of individual light sources that are attached to a flexible mat. The individual light sources of the flexible light baffle are electrically connected to a separate power supply.

The light source can be moved along a light baffle track system from the light box, through the service box, and out the front of the service box through the service door. The light baffle track system is comprised of one or more tracks that extend from the service box through the light box. While in use position, the flexible light baffle is substantially vertical and parallel with the sign face. Upon removal of the flexible light baffle, the light baffle track system guides the flexible light baffle from a substantially vertical orientation inside the light box to a substantially horizontal orientation outside the lighting system. Conversely, upon installing the flexible light baffle, the light baffle track system turns the flexible light baffle from a substantially horizontal orientation outside the lighting system to a substantially vertical orientation inside the light box.

Moreover, the flexible light baffle and light baffle track system work in concert to efficiently turn the flexible light baffle solely within the service box such that the height and depth of the service box is minimized.

Accordingly, the flexible light baffle can be accessed solely from the front of the service box, wherein the size of the service box is minimized relative to the light box, the front of the service door appears ornamental with little to no evidence of hinges, handles, screws, or other devices that would suggest the service door's functionality, and the overall design of the lighting system provides a cost effective, time efficient, or practical means to access the light source.

Each of the embodiments described herein can be used alone or in combination with one another. Various embodiments will now be described with reference to the attached drawings.

DETAILED DESCRIPTION OF THE PRESENTLY PREFERRED EMBODIMENTS

The following embodiments are generally directed to a lighting system. These embodiments describe a light source of a lighting system that can be accessed solely from the front of the lighting system through an inconspicuous service box. One advantage is that renewal, replacement, repair or other maintenance of the light source may be efficiently performed solely from the front of the lighting system even when moving or removing a sign face would be cost prohibitive, time consuming, highly impractical, or otherwise undesirable. Accordingly, the lighting system may be affixed to a myriad of places and in a myriad of configurations without need to access the light source from the top, sides, or rear of the lighting system. Another advantage is the ability to access the light source through the front of the service box does not significantly impact sign efficacy or aesthetic appeal because the area of the front of the service box is minimized in relation to the area of the front of the sign face. In addition, the door of the service box in a closed position appears ornamental with little to no evidence of hinges, handles, screws, or other devices that would suggest functionality. These embodiments will be described in more detail below.

Figure 1:
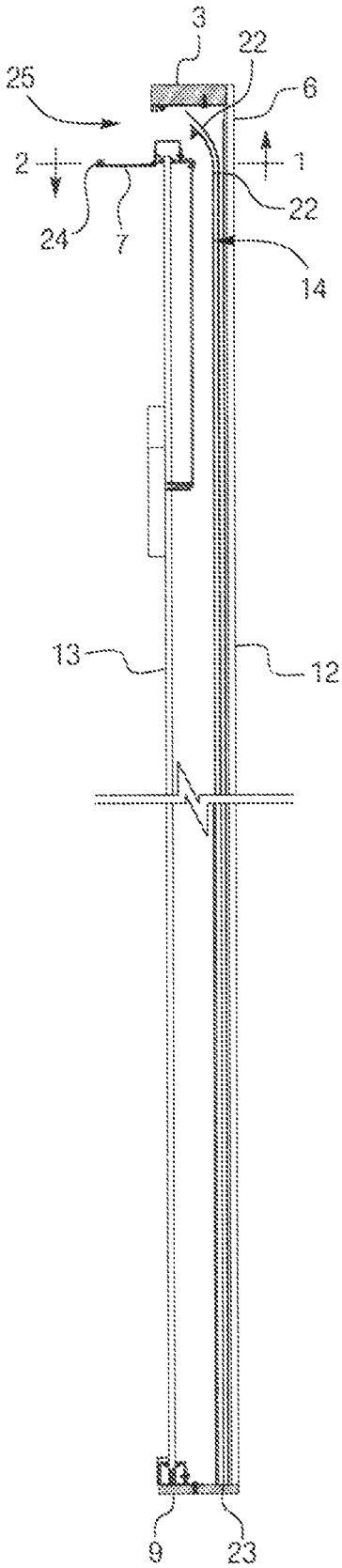
FIG. 1 is a cross sectional side view of a service box and light box of an embodiment.
Figure 2A:
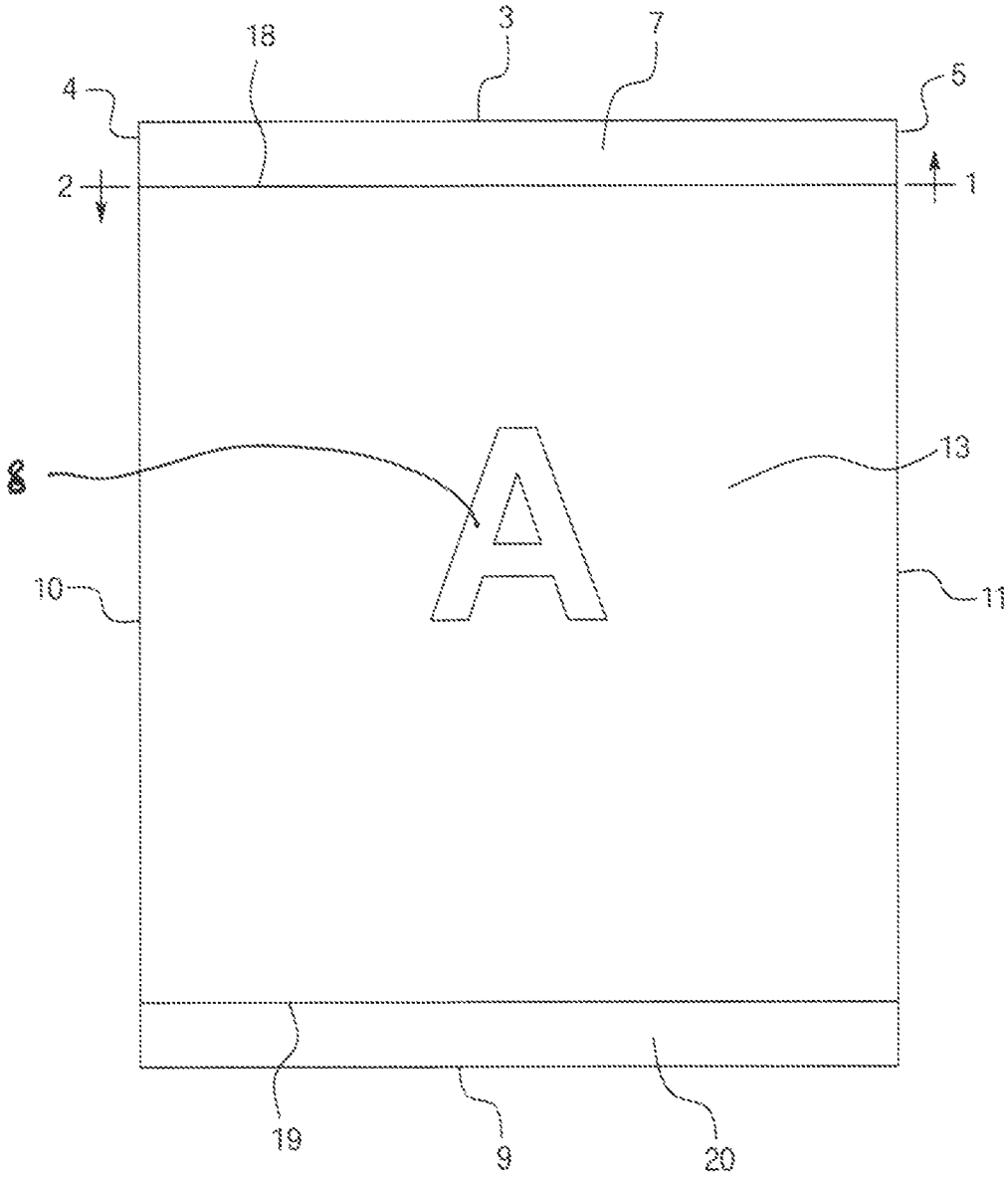
FIG. 2A is a front elevational view of a lighting system of an embodiment.
Figure 2B:
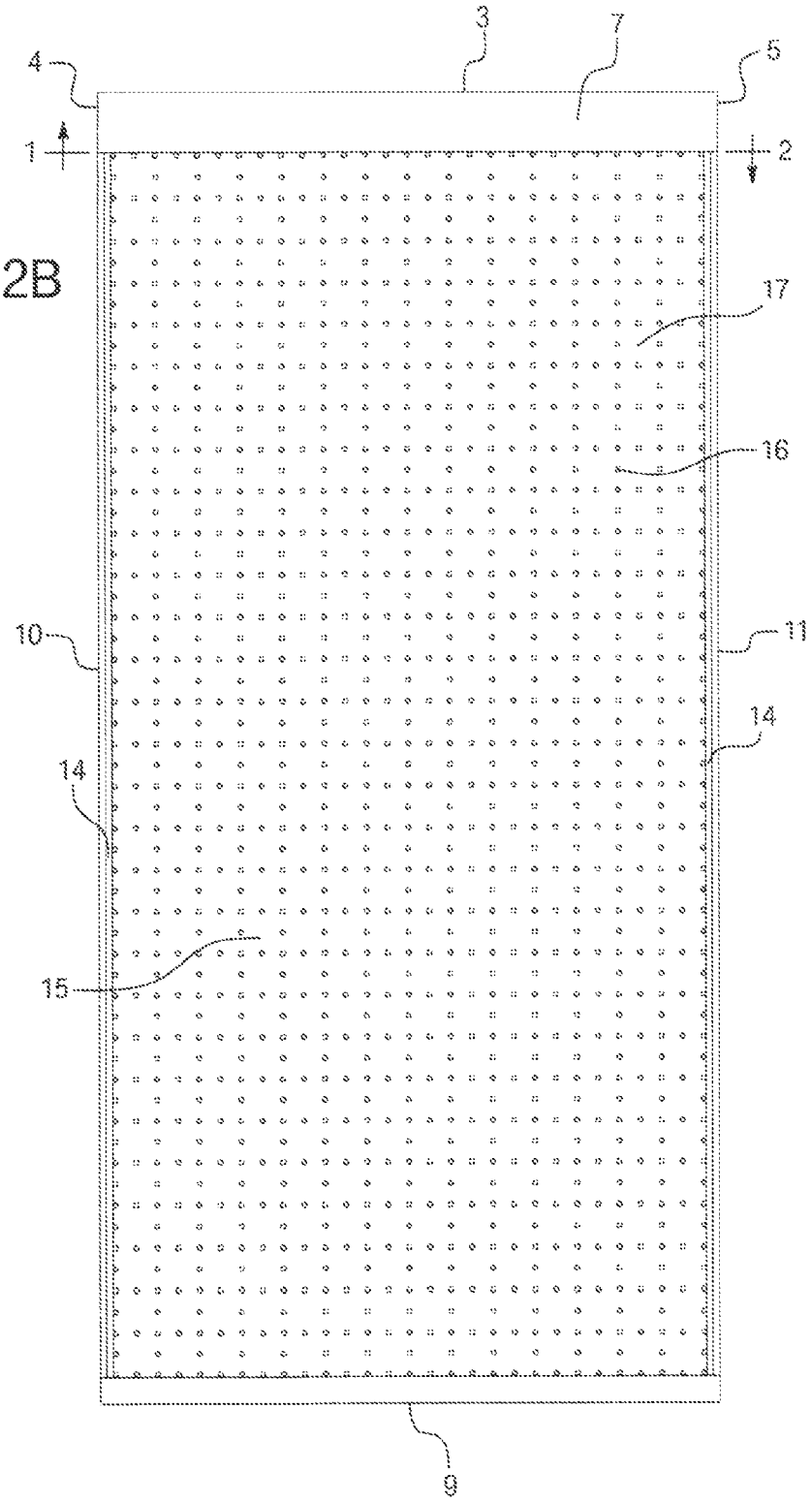
FIG. 2B is a front elevational view of an embodiment, wherein the sign face has been removed for illustrative purposes exposing multiple flexible light baffles and multiple light baffle track systems.

Turning now to the drawings, FIG. 1 shows a cross sectional side view of an embodiment, FIG. 2A shows a front elevational view of an embodiment, and FIG. 2B shows a front elevational view of an embodiment, wherein a sign face has been removed for illustrative purposes exposing a flexible light baffle and a light baffle track system. The embodiment comprises service box 1 and light box 2, wherein service box 1 and light box 2 are connected and open to the other. In addition, the service box 1 and light box 2 are generally made of metal or other material known to a person having ordinary skill in the art. In a preferred embodiment, the service box 1 and light box 2 are substantially made of aluminum.

The service box 1 is comprised of distal side 3, first service box side 4, second service box side 5, service box rear side 6, and service box front side 25. Service box front side 25 comprises front door 7. Front door 7 is connected to service box front side 25. Alternatively, service box front side 25 comprises front door 7 and a door frame, wherein the door frame of front door 7 is connected to service box distal side 3 and one or more sign faces 13.

Front door 7 may be attached to the embodiment by screws, bolts, or similar means. However, means of attachment that are visible from the front of the embodiment when front door 7 is in a closed position are aesthetically displeasing. In a preferred embodiment, front door 7 is hingedly connected such that the hinge is hidden from the front of the embodiment when front door 7 is in a closed position.

Front door 7 is also equipped with front door latch 24. A wide variety of latches may be used including compression, cam, push-to-close, or draw latches. In a preferred embodiment, a magnetic latch is used that can be hidden from outside the embodiment when front door 7 is in a closed position.

Generally, the height of service box 1 is substantially equal to or a little longer than the distance between the surface of one or more sign faces 13 inside light box 2 and one or more rear tracks 22, wherein the sign faces 13 and rear tracks 22 are described in detail below. The depth of distal side 3 is longer than the height of service box 1. The width of service box 1 is slightly longer than the width of flexible light baffle 15, which is described below.

By way of example, if the height of service box 1 is desired to be 4 to 5 inches (10.16 to 12.70 cm), then the distance between the surface of one or more sign faces 13 inside light box 2 and one or more rear tracks 22 is 3.75 to 4.75 inches (9.53 to 12.07 cm) and the depth of distal side 3 is 5.25 to 6.25 inches (13.34 to 15.88 cm). In a preferred embodiment, if the height of service box 1 is desired to be 4.5 inches (11.43 cm), then the distance between the surface inside light box 2 of one or more sign faces 13 and one or more rear tracks 22 is 4.25 inches (10.80 cm) and the depth of distal side 3 is 5.75 inches (14.61 cm). The width of the service box 1, for example, may range from around 6 inches (15.24 cm) to 6 feet (1.83 m).

Light box 2 is comprised of light box distal side 9 that is opposite service box distal side 3, first light box side 10, second light box side 11, light box rear side 12, and one or more sign faces 13. Light box rear side 12 connects to service box rear side 6 to create a rear wall that extends the length of the embodiment. The height and width of light box 2 varies by application, although the height and width of light box 2 is slightly longer than the height and width of flexible light baffle 15, which will be described in detail below. Additionally, the depth and width of light box distal side 9 is substantially equal to the depth and width of distal side 3.

The sign face 13 may be made of any transparent or semi-transparent material known by a person having ordinary skill in the art. In a preferred embodiment, sign face 13 is made of a durable, scratch resistant, and semi-transparent material that will not discolor over time when exposed to ultraviolet light.

By way of example, sign face 13 may be made of glass or thermoplastic such as poly(methyl methacrylate) (e.g., PLEXIGLAS) or polycarbonate (e.g., LEXAN). In a preferred embodiment, the sign face 13 is made of glass. Although glass is substantially heavier than other alternatives, glass may be preferred, for example, for its scratch-resistant characteristics and long-term color stability under ultraviolet light.

Sign face 13 may also be equipped with optional secondary graphic 8. As depicted in FIGS. 1 and 2A, optional secondary graphic 8 is mounted on the one or more sign faces 13. Optional secondary graphic 8, for example, may be a trademark, lettering, or other graphic. In a preferred embodiment, optional secondary graphic 8 is lighted and electrically connected to a power supply.

The optional secondary graphic 8 is connected to an optional wire guide 43 that extends through the one or more sign faces 13 and towards light box rear side 12 before extending vertically to the power supply. The purpose of optional wire guide 43 is to guide electrical wires of the optional secondary graphic 8 away from the one or more sign faces 13 thereby preventing the electrical wires from casting an undesirable shadow on sign face 13 when the lighting system is in use. In a preferred embodiment, the vertical segment of wire guide 43 extends adjacent to flexible light baffle 15, which is described below. Optional wire guide 43 is generally tubular and can be made of thermoplastic, metal, or any other material known to a person having ordinary skill in the art. In a preferred embodiment, optional wire guide 43 is an aluminum tube.

The embodiment also comprises light baffle track system 14 and flexible light baffle 15. In general, flexible light baffle 15 serves as a removable light source. The size of flexible light baffle 15 varies by application. For example, the width of flexible light baffle 15 may range from around 6 inches (15.24 cm) to 6 feet (1.83 m), and the height may range from around 1 to 10 feet (0.03 to 3.05 m).

Flexible light baffle 15 is comprised of one or more light sources 16, which are attached to a flexible baffle mat 17. The one or more light sources 16 are electrically connected to one or more power supplies. In a preferred embodiment, a plurality of light sources 16 are evenly spaced across flexible baffle mat 17. The flexible baffle mat 17 may be made of 0.01 to 0.03 inch (0.025 to 0.076 cm) flexible and clear thermoplastic material such as poly(methyl methacrylate) (e.g., PLEXIGLAS) or polycarbonate (e.g., LEXAN). In a preferred embodiment, the flexible baffle mat 17 is 0.02 inch (0.051 cm) flexible polycarbonate.

The one or more light sources 16 can be incandescent lamps, fluorescent lamps, high intensity discharge lamps, mercury vapor lamps, metal halide lamps, high pressure sodium lamps, low pressure sodium lamps, solid state lighting, or any other means to transmit sufficient light to illuminate the one or more sign faces 13 from inside light box 2. In a preferred embodiment, the one or more light sources 16 are a form of solid state lighting called light emitting diodes ("LED"). In solid-state lighting, semiconducting material converts electricity directly into light while creating little to no heat. This form of lighting can be as bright as incandescent lighting and is energy efficient. LEDs in particular have great potential as a cost-effective option in small areas such as the inside of light box 2.

It is generally desired that the one or more light sources 16 are evenly spaced to project consistent light across sign face 13. The one or more power supplies are selected based on technical requirements of the one or more light sources 16 and space restrictions inside service box 1 and light box 2.

Light baffle track system 14 is used to guide and support flexible light baffle 15 into and out of the embodiment through front door 7 during, for example, maintenance of the one or more light sources 16. Light baffle track system 14 is generally connected to service box 1, light box 2, or to both service box 1 and light box 2 by means known by a person having ordinary skill in the art. For example, light baffle track system 14 may be bolted to service box 1 and to light box 2. Turning back to FIG. 1, the light baffle track system 14 substantially extends from service box 1 through light box 2. In service box 1, the distal end of light baffle track system 14 is oriented 30 to 90 degrees from the vertical plane of the one or more sign faces 13. As light baffle track system 14 extends through service box 1, light baffle track system 14 curves to an orientation of 0 to 5 degrees from the vertical plane of the one or more sign faces 13. Light baffle track system 14 remains 0 to 5 degrees from the vertical plane of the one or more sign faces 13 as light baffle track system 14 extends through light box 2 and adjacent to light box rear side 12. Alternatively said, the light baffle track system 14 remains substantially parallel to the one or more sign faces 13 throughout light box 2. Therefore, flexible light baffle 15 provides an equal and consistent light source to the one or more sign faces 13.

Figure 5A:
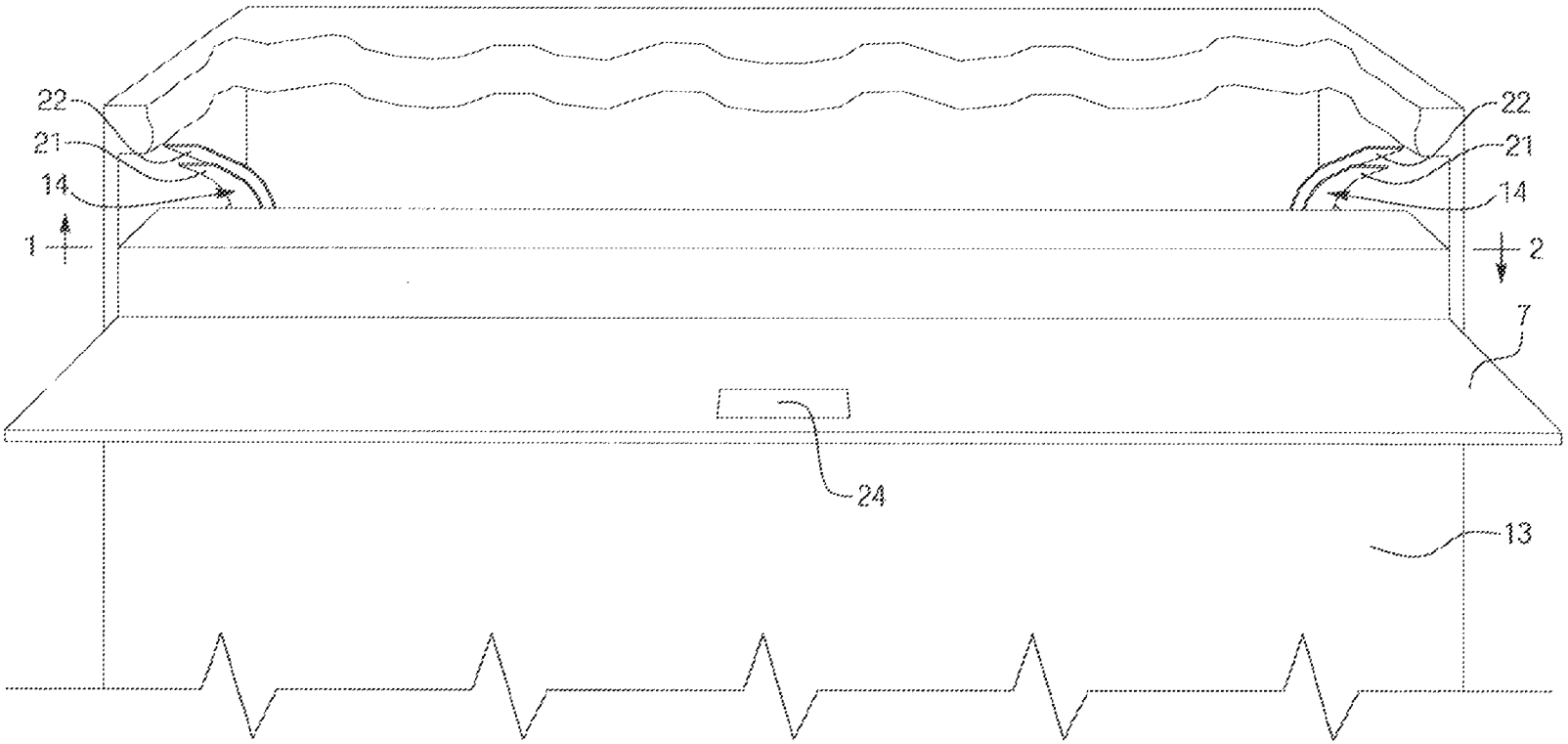
FIG. 5A is a fragmented perspective view of a service box and a light box of an embodiment, wherein an access door of the service box is open exposing the top of a light baffle track system.
Figure 5B:
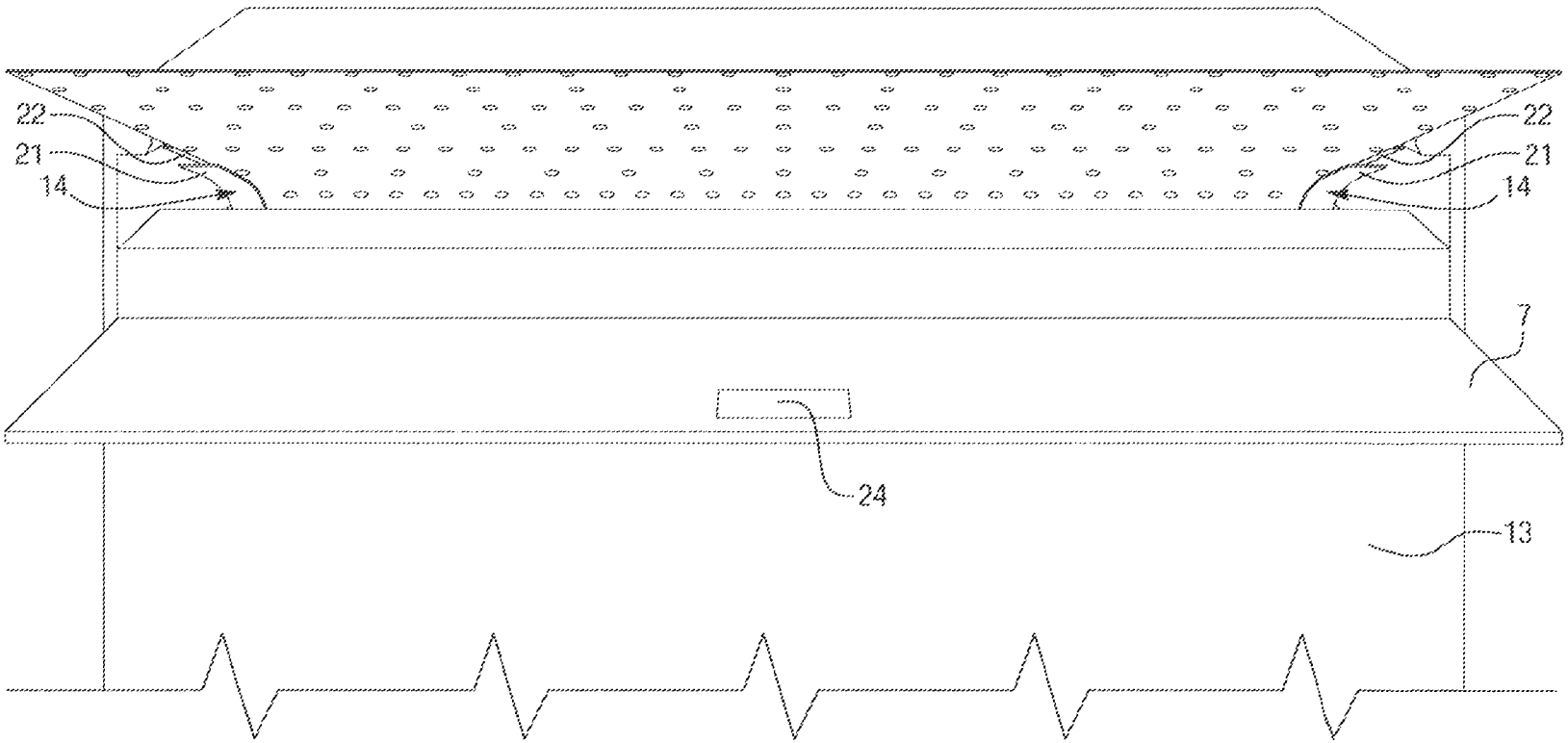
FIG. 5B is a fragmented perspective view of a service box and a light box of an embodiment, wherein an access door of the service box is open and a flexible light baffle is partially installed into the light baffle track system.

Turning to FIGS. 1, 5A, and 5B, light baffle track system 14 generally is comprised of one or more front tracks 21 and one or more rear tracks 22. FIG. 5A shows a fragmented perspective view of service box 1 and light box 2 of an embodiment, wherein front door 7 of service box 1 is in an open position exposing the top of light baffle track system 14. FIG. 5B shows a fragmented perspective view of service box 1 and light box 2 of an embodiment, wherein front door 7 of service box 1 is in an open position and flexible light baffle 15 is partially installed into light baffle track system 14.

The one or more front tracks 21 of the light baffle track system 14 are substantially parallel to the one or more rear tracks 22. The one or more front tracks 21 and the one or more rear tracks 22 are spaced to guide and support flexible light baffle 15 as it slides into and out of the embodiment solely through front door 7. In an embodiment, the one or more front tracks 21 and the one or more rear tracks 22 are spaced approximately 10 to 40 times the thickness of flexible baffle mat 17. For example, if flexible baffle mat 17 is 0.02 inch (0.051 cm), the one or more front tracks 21 and the one or more rear tracks 22 are spaced 0.25 to 0.75 inch (0.64 to 1.91 cm) apart.

The light baffle track system 14 may comprise one front track and one rear track that extends the width of service box 1 and light box 2 if the tracks are made of a transparent thermoplastics such as poly(methyl methacrylate) (e.g., PLEXIGLAS) or polycarbonate (e.g., LEXAN). However, in a preferred embodiment the light baffle track system 14 comprises one front track 21 and one rear track 22 that runs adjacent to light box side 10 and one front track 21 and one rear track 22 that runs adjacent to light box side 11. From the perspective of FIG. 2B, the width of light baffle track system 14 in the embodiment is generally 0.5 to 1.0 inch (1.27 to 2.54 cm). In a preferred embodiment, the width of light baffle track system 14 is 0.75 inch (1.91 cm).

Returning to FIGS. 1, 5A, and 5B, in service box 1, the one or more rear tracks 22 may extend past the one or more front tracks 21. In a preferred embodiment, the one or more rear tracks 22 extend past the one or more front tracks 21 by two to six times the distance between the one or more rear tracks 22 and the one or more front tracks 21.

When inserting flexible light baffle 15 into light baffle track system 14, the extended one or more rear tracks 22 guide the flexible light baffle 15 into the remainder of light baffle track system 14. At or near the light box distal side 9, light baffle track system 14 is equipped with a stop 23 to ensure light baffle track system 14 guides flexible light baffle 15 into use position, wherein the flexible light baffle 15 is substantially parallel with the one or more sign faces 13. As depicted in FIG. 1, light box distal side 9 serves as the stop 23.

The one or more front tracks 21 and one or more rear tracks 22 are made of material that will guide and support flexible light baffle 15 as described herein. For example, the one or more front tracks 21 and one or more rear tracks 22 may be made of sheet metal. In a preferred embodiment, the one or more front tracks 21 and one or more rear tracks 22 are made of sheet aluminum. Alternatively, the one or more front tracks 21 and one or more rear tracks 22 may be made of, covered with, or coated with synthetic material such as thermoplastics. Low friction thermoplastics including polytetrafluoroethylene (e.g., TEFLON), polyoxymethylene, nylon, or ultra-high-molecular-weight polyethylene may enhance the guiding function of the light baffle track system 14. Alternatively, transparent thermoplastics such as poly(methyl methacrylate) (e.g., PLEXIGLAS) or polycarbonate (e.g., LEXAN) may be used if the light baffle track system 14 partially or entirely obstructs the one or more sign faces 13 from the one or more light sources 16.

The shape, orientation, guide function, and support function of light baffle track system 14 may be further described by relating the method of servicing flexible light baffle 15. Turning to FIGS. 1, 5A, and 5B, first, front door 7 of service box 1 is opened revealing, in part, the distal end of light baffle track system 14. The flexible light baffle 15 is initially in a use position, wherein light baffle track system 14 supports flexible light baffle 15 such that flexible light baffle 15 is substantially flat and parallel to the plane of the one or more sign faces 13. Alternatively said, flexible light baffle 15 is 0 to 5 degrees from the plane of the one or more sign faces 13. In a preferred embodiment, the one or more sign faces 13 are substantially vertical. In use position, the distal end of flexible light baffle 15 may or may not be visible through an open front door 7 of service box 1. However, flexible light baffle 15 may be reached through front door 7.

Before removing flexible light baffle 15, the electrical wires of the one or more light sources 16 are detached from the one or more power supplies.

Next, flexible light baffle 15 is slid from use position inside light box 2, along the linear portion of the tracks of light baffle track system 14 inside light box 2, around the curved portion of light baffle track system 14 inside service box 1, off the distal end of light baffle track system 14, and out front door 7. Flexible light baffle 15 bends in the direction it traverses light baffle track system 14. Conversely, in the cross direction light baffle track system 14 supports and maintains flexible light baffle 15 in a substantially flat position. A safety guide 44 with a smooth edge extends the width of service box 1 to ensure the one or more light sources 16, or their associated electrical wires, are not damaged as the flexible light baffle 15 is removed from service box 1.

Light baffle track system 14 at the distal end in service box 1 is oriented 30 to 90 degrees from the plane of the one or more sign faces 13, wherein flexible light baffle 15 exits light baffle track system 14 at an angle of 30 to 90 degrees from the plane of the one or more sign faces 13. In a preferred embodiment, light baffle track system 14 is oriented 40 to 60 degrees from the plane of the one or more sign faces 13.

To achieve the desired orientation of light baffle track system 14 at the distal end in service box 1, light baffle track system 14 turns in service box 1 at a radius substantial equal to, or slightly longer than, the height of service box 1. For example, if the height of service box 1 is 4 to 5 inches (10.16 to 12.70 cm), the turning radius of light baffle track system 14 would be 4.5 to 5.5 inches (11.43 to 13.97 cm). In a preferred embodiment, the height of service box 1 is 4.5 inches (11.43 cm) and the turning radius of the light baffle track system 14 is 5 inches (12.70 cm).

Then, flexible light baffle 15 is renewed, replaced, repaired or otherwise serviced by means known to a person having ordinary skill in the art.

Next, flexible light baffle 15 is slid through front door 7 of service box 1, into light baffle track system 14, around the curved portion of light baffle track system 14 inside service box 1, along the linear portion of the tracks of light baffle track system 14 inside light box 2, and into use position inside light box 2. The flexible light baffle 15 bends in the direction the flexible light baffle 15 traverses light baffle track system 14. Conversely, in the cross direction the light baffle track system 14 supports and maintains flexible light baffle 15 in a substantially flat position.

Finally, the electrical wires of the one or more light sources 16 are attached to the one or more power supplies and front door 7 of service box 1 is closed.

As described in the method of servicing flexible light baffle 15, flexible light baffle 15 and light baffle track system 14 work in concert to efficiently turn flexible light baffle 15 30 to 90 degrees within service box 2, thereby minimizing the height and depth of service box 2. Accordingly, flexible light baffle 15 can be accessed solely from the front of service box 2, the height of service box 2 is minimized relative to the height of light box 1, and the overall design of the embodiment provides a cost effective, time efficient, or practical means to service the flexible light baffle 15.

Figure 6:
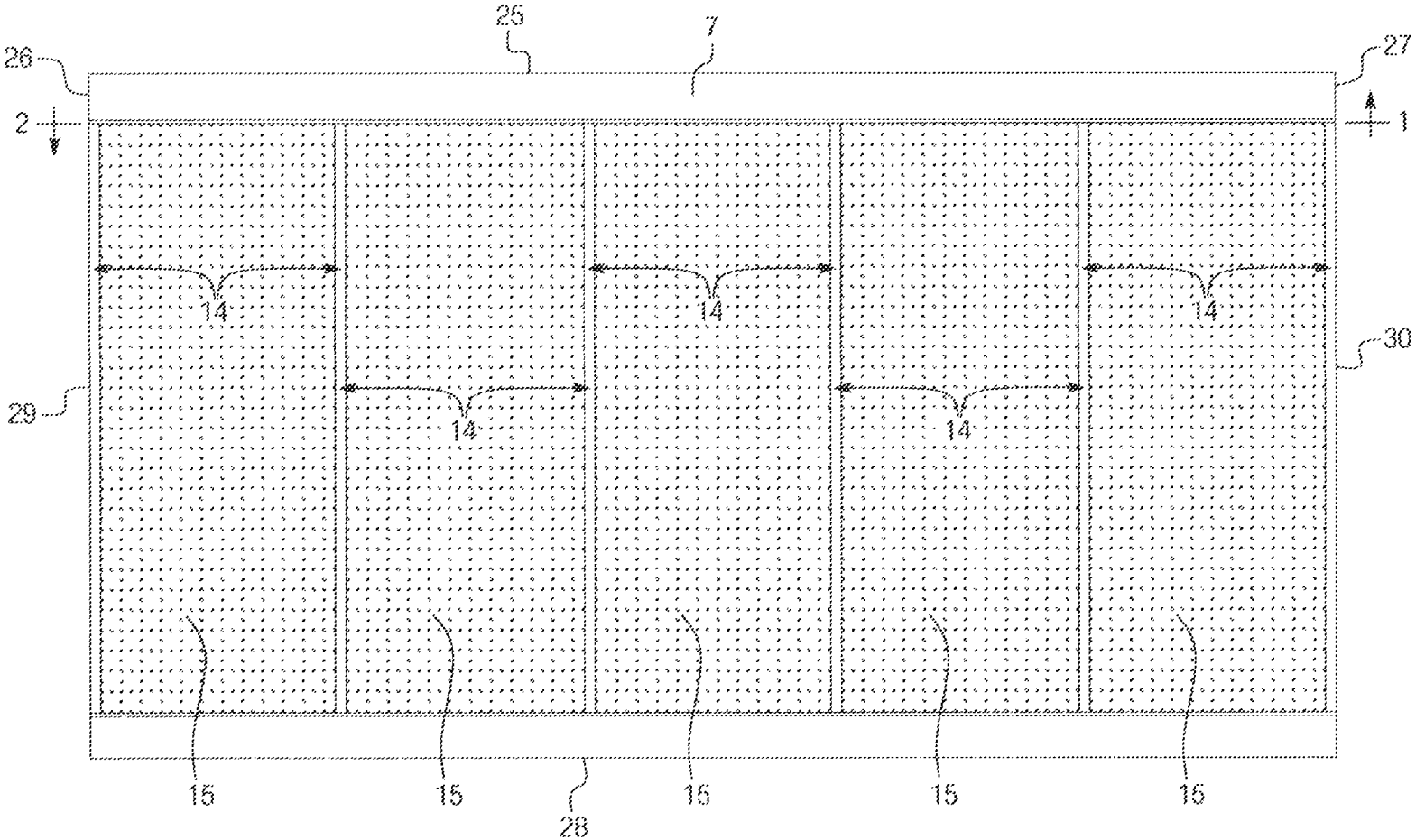
FIG. 6 is a front elevational view of an embodiment, wherein multiple lighting systems are in a side-by-side configuration, and the sign faces has been removed exposing multiple flexible light baffles and multiple light baffle track systems.

FIG. 6 is a front elevational view of a further embodiment, wherein five lighting systems are in a side-by-side configuration, and the sign faces has been removed for illustrative purposes exposing multiple flexible light baffles 15 and multiple light baffle track systems 14.

The branding wall in the embodiment may comprise multiple lighting systems in a side-by-side configuration and embedded in a non-illuminated wall, wherein the non-illuminated wall is adjacent to one or more sides of the multiple lighting systems. Common with both embodiments, the ceiling, floor, non-illuminated wall, or other obstruction restrict access to the top, bottom, sides, and rear of the multiple light system in a side-by-side configuration.

The multiple lighting systems in a side-by-side configuration comprise service box 1, light box 2, multiple service box distal side 25, first multiple service box side 26, second multiple service box side 27, multiple light box distal side 28, first multiple light box side 29, second multiple light box side 30, five flexible light baffle 15, and multiple light baffle track systems 14. The embodiment also comprises one front door 7, although multiple doors may be used. Each flexible light baffle 15 has an independent light baffle track system 14. However, in a preferred embodiment one flexible light baffle 15 shares a light baffle track system 14 with an adjacent flexible light baffle 15. Although not depicted in FIG. 6, the embodiment also comprises one or more sign faces. When more than one sign face is used, the sign faces are commonly fused together by means known to a person having ordinary skill in the art to give the appearance of one continuous sign face. For example, the one of more sign faces may be fused together by a silicone caulking process. The sign faces are attached to the front of the lighting system by means of channel extrusions or mullions, because other means of attachment such as screws or bolts are undesirable and aesthetically displeasing. The additional size and weight of the one or more sign faces of the side-by-side configuration makes moving or removing the sign faces even more cost prohibitive, even more time consuming, even more impractical, or otherwise undesirable.

As described above, the flexible light baffles 15 and light baffle track systems 14 work in concert to efficiently turn the flexible light baffles 15 30 to 90 degrees within service box 2, thereby minimizing the height and depth of service box 2. Accordingly, the flexible light baffles 15 can be accessed solely from the front of service box 2, the height of service box 2 is minimized relative to the height of light box 1, and the overall design of the embodiment provides a cost effective, time efficient, or practical means to service the flexible light baffle 15.

Figure 7:
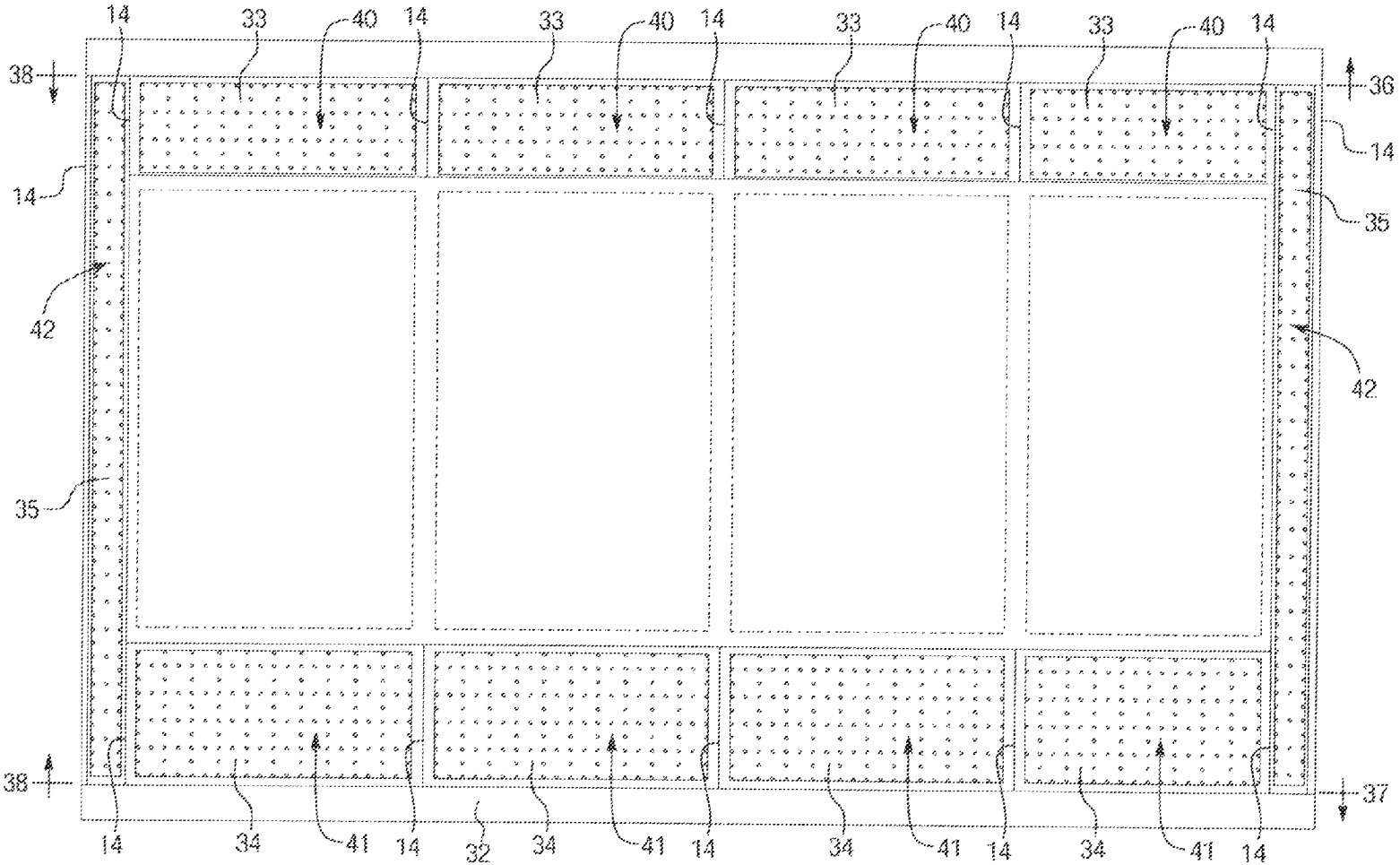
FIG. 7 is a front elevational view of an embodiment, wherein multiple lighting systems are in wraparound configuration, and the sign faces have been removed exposing multiple flexible light baffles and multiple light baffle track systems.

FIG. 7 is a front elevational view of an alternative multiple lighting system embodiment, wherein multiple lighting systems are in wraparound configuration, and the sign faces have been removed for illustrative purposes exposing multiple flexible light baffles and multiple light baffle track systems. Multiple lighting systems are generally positioned in a wraparound configuration to create a branding wall that, in essence, frames an unrelated object. The unrelated object, for example, may be an ATM. ATMs are often comprised of an ATM face and an ATM cabinet. The ATM face comprises a monitor, printer, card reader, and keypad, which are accessible by a consumer in a front room. The ATM cabinet comprises a central processing unit, communication device, cash dispenser, security device, and access door. The ATM cabinet is often located in a rear room adjacent to the front room. The ATM cabinet in the rear room may restrict access to the rear of the lighting systems. Moreover, the rear room is generally not accessible by maintenance personnel for security reasons. Access to all sides, the top, and the bottom of the lighting system is restricted by the interface of the lighting system and the ATM face, the ceiling of the room, the floor of the room, non-illuminated walls, or other obstructions. Therefore, access to the light source is required solely from the front of the multiple lighting systems.

Figure 3:
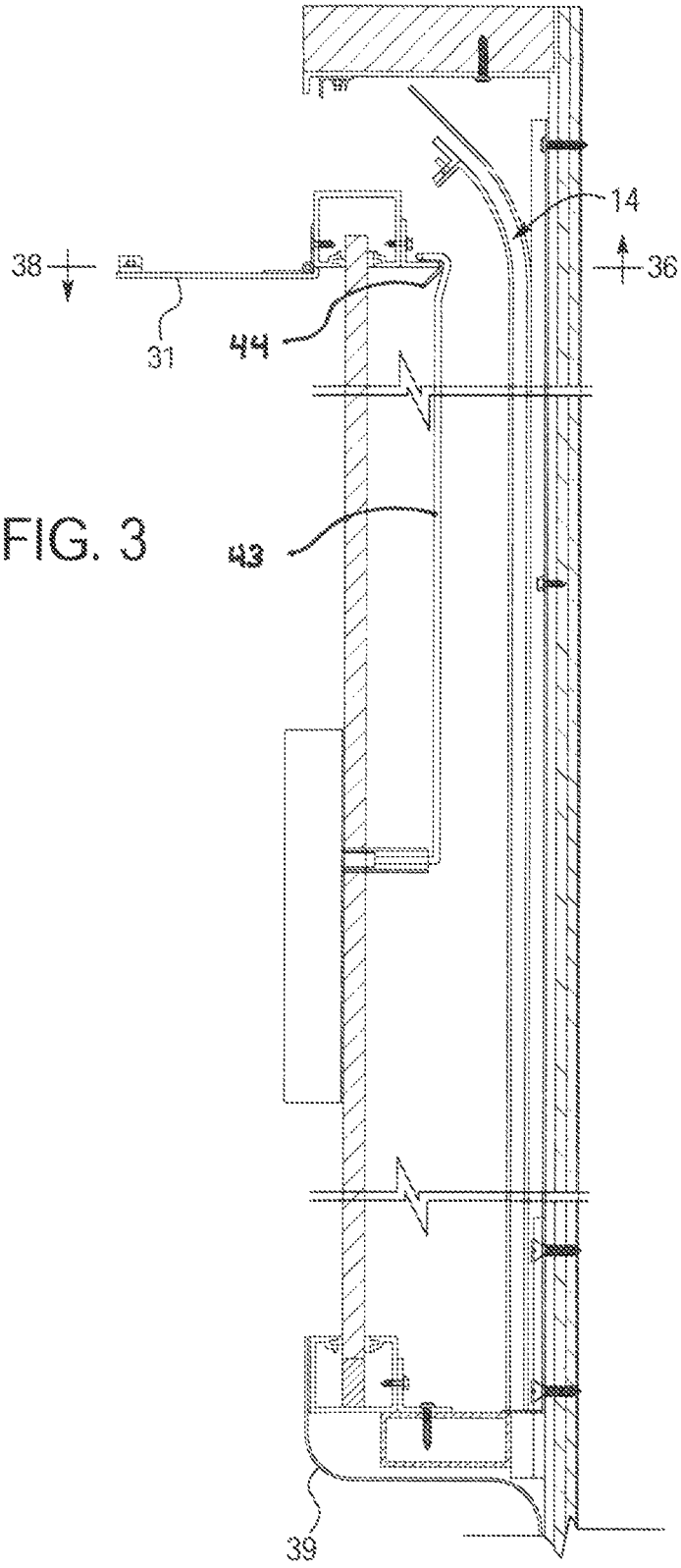
FIG. 3 is a cross sectional side view of an embodiment, wherein a service box is located at the top of a light box.
Figure 4:
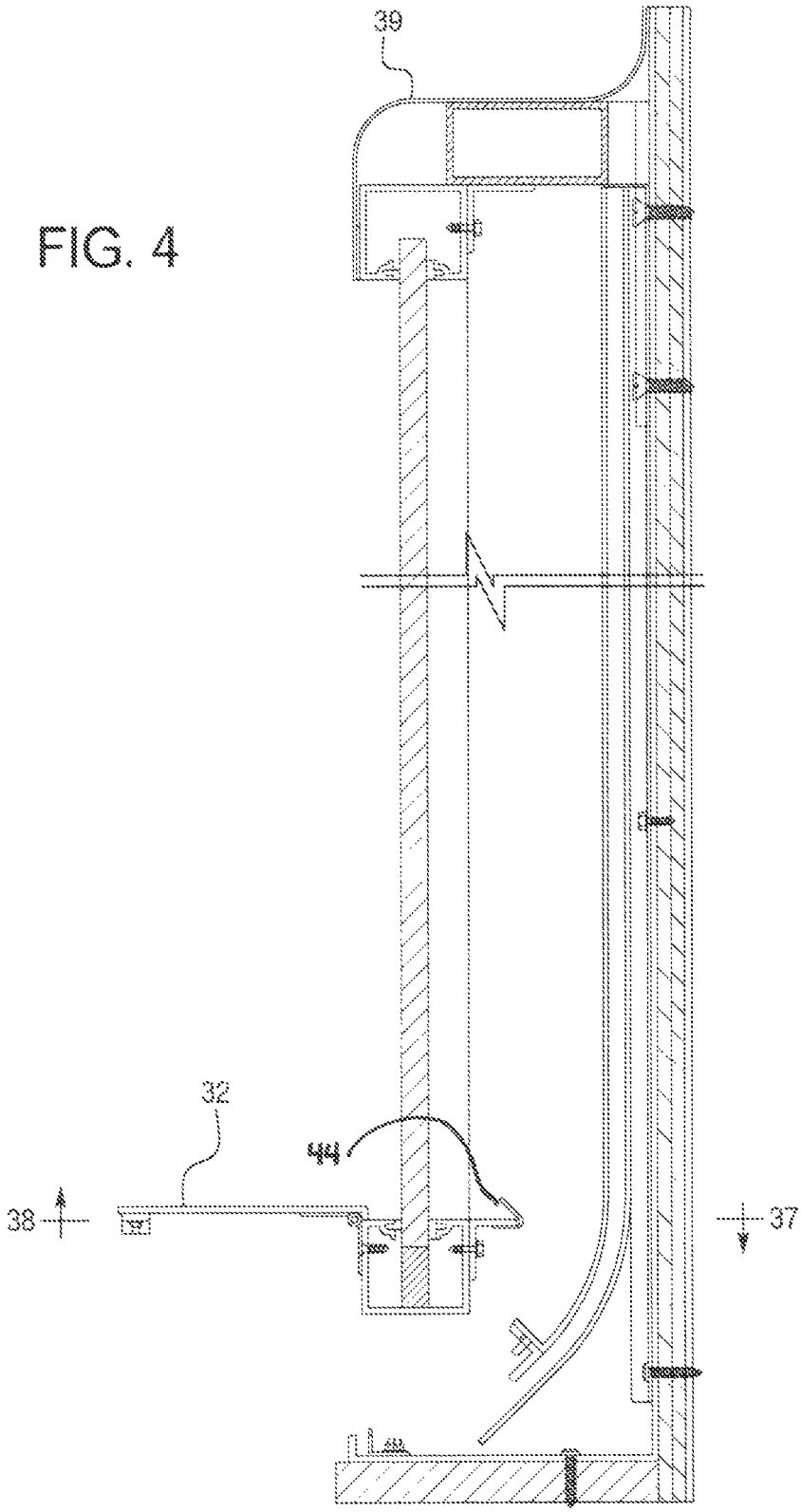
FIG. 4 is a cross sectional side view of an embodiment, wherein a service box is located at the bottom of a light box.

The multiple lighting systems in a wraparound configuration in FIG. 7 comprise upper lighting systems 40, lower lighting systems 41, and side lighting systems 42. The multiple lighting systems in a wraparound configuration further comprise upper front door 31, lower front door 32, upper flexible light baffles 33, lower flexible light baffles 34, side flexible light baffles 35, upper service box 36, lower service box 37, center light box 38, and multiple light baffle track systems 14. Upper front door 31 provides front access to side flexible light baffles 35 and upper flexible light baffles 33. The embodiment comprises one upper front door 31, although multiple doors may be used. Each side flexible light baffles 35 and upper flexible light baffle 33 have an independent light baffle track system 14. In a preferred embodiment, one upper flexible light baffle 33 shares a light baffle track system 14 with an adjacent upper flexible light baffle 33; an upper flexible light baffles 33 shares a light baffle track system 14 with the top of an adjacent side flexible light baffle 35; and an lower flexible light baffle 34 shares a light baffle track system 14 with the bottom of an adjacent side flexible light baffle 35. FIG. 3 is a cross sectional side view of upper lighting system 40, wherein the upper service box 36 and upper front door 31 are located at the top of center light box 38. In addition, the embodiment comprises a modified light box distal side 39 shaped to interface with the top of the unrelated object (e.g., an ATM face). FIG. 3 is a cross sectional side view of a lower lighting system 41, wherein the lower service box 37 and lower front door 32 are located at the top of center light box 38. In addition, the embodiment comprises a modified light box distal side 39 shaped to interface with the top of the unrelated object (e.g., an ATM face).

Although not depicted in FIG. 7, the embodiment also comprises one or more sign faces that wraparound the unrelated object (e.g., an ATM face). When more than one sign face is used, the sign faces are commonly fused together by means known to a person having ordinary skill in the art to give the appearance of one continuous sign face. The one or more sign faces are attached to the wraparound lighting system by means of channel extrusions or mullions, because other means of attachment such as screws or bolts are undesirable and aesthetically displeasing. The wraparound shape, size, and weight of the one or more sign faces make moving or removing the one or more sign face even more cost prohibitive, even more time consuming, even more impractical, or otherwise undesirable.

As described above, upper flexible light baffles 33 and light baffle track systems 14 work in concert to efficiently turn the upper flexible light baffles 33 30 to 90 degrees within upper service box 36, thereby minimizing the height and depth of the upper service box 36. Similarly, lower flexible light baffles 34 and light baffle track systems 14 work in concert to efficiently turn the lower flexible light baffles 34 30 to 90 degrees within lower service box 37, thereby minimizing the height and depth of the lower service box 37. Accordingly, upper flexible light baffles 33 and lower flexible light baffles 34 can be accessed solely from the front of upper service box 36 and lower service box 37, respectively; the height of upper service box 36 and lower service box 37 are minimized relative to the height center light box 38, and the overall design of the embodiment provides a cost effective, time efficient, or practical means to service upper flexible light baffles 33, lower flexible light baffles 34, and side flexible light baffles 35.

It is intended that the foregoing detailed description be understood as an illustration of selected forms that the invention can take and not as a definition of the invention. It is only the following claims, including all equivalents, that are intended to define the scope of this invention. Finally, it should be noted that any aspect of any of the embodiments described herein can be used alone or in combination with one another.

What is claimed is:

1. An apparatus comprising:

a service box comprising a first service box side, a second service box side, a service box rear side, a service box distal side, a service box open side opposite the service box distal side, and a service box front side, wherein a front door is connected to the service box front side and the front door opens away from the service box;

a light box comprising a front sign face, a first light box side, a second light box side, a light box rear side, a light box distal side opposite the service box distal side, and a light box open side opposite the light box distal side, wherein the light box open side is connected to the service box open side;

a light baffle track system comprising one or more tracks, wherein the one or more tracks extend from the service box through the light box, wherein the one or more tracks have a service box distal end and a light box distal end, the service box distal end of the one or more tracks is connected to the service box and light box distal end of the one or more tracks is connected to the light box, wherein the one or more tracks are oriented 30 to 90 degrees from the plane of the front sign face at the service box distal end and curves to 0 to 5 degrees from the plane of the front sign face prior to the one or more tracks extending to the light box, the one or more tracks extend through the light box oriented 0 to 5 degrees from the plane of the front sign face; and a removable flexible light baffle comprising one or more light sources, one or more power sources, and a baffle mat, wherein the baffle mat has a service box distal end, a light box distal end, a first side, and a second side, wherein the one or more light sources are connected to the baffle mat and the power source, wherein the removable flexible light baffle is connected to the baffle track system.

2. The apparatus of claim 1, wherein the first service box side, the second service box side, the service box rear side, the service box distal side, the front sign face, the first light box side, the second light box side, the light box rear side, and the light box distal side are fixed.

3. The apparatus of claim 2, wherein the one or more tracks at the service box distal end are oriented 40 to 60 degrees from the plane of the front sign face.

4. The apparatus of claim 3, wherein the front door in a closed position conceals all hinges, handles, screws, and other means in which the front door is connected to the service box.

5. The apparatus of claim 4, wherein the height of the service box is 4 to 5 inches (10.16 cm to 12.70 cm) and the depth of the service box distal side is 5.25 to 6.25 inches (13.34 to 15.88 cm).

6. The apparatus of claim 5, wherein the height of the service box is 4.5 inches (11.43 cm) and the depth of the service box distal side is 5.75 inches (14.61 cm).

7. The apparatus of claim 5, wherein the turning radius of the light baffle track system is 4.5 to 5.5 inches (11.43 to 13.97 cm).

8. The apparatus of claim 7, wherein the turning radius of the light baffle track system is 5 inches (12.70 cm).

9. The apparatus of claim 8, wherein the removable flexible light baffle is comprised of 0.01 to 0.03 inch (0.025 to 0.076 cm) polycarbonate.

10. The apparatus of claim 9, wherein the one or more light sources are light emitting diodes.

11. A branding wall with a first distal end and a second distal end comprising:

one or more front sign faces with a first distal end and a second distal end, wherein the second end of the one or more sign faces connects to the second distal end of the branding wall;

one or more access doors, wherein the one or more access doors connect to the first distal end of the branding wall and to the first distal end of the one or more front sign faces;

a rear wall substantially parallel to the one or more front sign faces, wherein the rear wall connects to the first distal end of the branding wall and to the second distal end of the branding wall;

a light baffle track system connected to the rear wall, wherein the light baffle track system is comprised of one or more tracks, wherein the one or more tracks extend from at or near the one or more access doors to the second distal end of the branding wall, wherein the one or more tracks at or near the access door are oriented 30 to 90 degrees from the plane of the one or more front sign faces and the one or more tracks curves to 0 to 5 degrees from the plane of the one or more sign faces prior to the one or more tracks extending to the first distal end of the one or more front sign faces, the one or more tracks extend from the first distal end of the one or more front sign faces to the second distal end of the branding wall 0 to 5 degrees from the plane of the one or more sign faces;

and a removable flexible light baffle comprising one or more light sources, one or more power sources, and a baffle mat, wherein the one or more light sources is connected to the baffle mat and the one or more power sources, wherein the removable flexible light baffle is connected to the baffle track system.

12. The apparatus of claim 11, wherein the one or more front sign faces are fixed.

13. The apparatus of claim 12, wherein the one or more tracks at or near the access door are oriented 40 to 60 degrees from the plane of the one or more front sign faces.

14. The apparatus of claim 13, wherein the one or more access doors in closed positions conceal all hinges, handles, screws, and other means in which the one or more access doors are connected to the first distal end of the branding wall.

15. The apparatus of claim 14, wherein the height of the one or more access doors in closed positions is 4 to 5 inches (10.16 cm to 12.70 cm) and the distance from the one or more access doors in closed positions to the rear wall is 5.25 to 6.25 inches (13.34 to 15.88 cm).

16. The apparatus of claim 15, wherein the height of the one or more access doors in closed positions is 4.5 inches (11.43 cm) and the distance from the one or more access doors in closed positions to the rear wall is 5.75 inches (14.61 cm).

17. The apparatus of claim 15, wherein the turning radius of the light baffle track system is 4.5 to 5.5 inches (11.43 to 13.97 cm).

18. The apparatus of claim 17, wherein the turning radius of the light baffle track system is 5 inches (12.70 cm).

19. The apparatus of claim 18, wherein the removable flexible light baffle is comprised of 0.01 to 0.03 inch (0.025 to 0.076 cm) polycarbonate.

20. The apparatus of claim 19, wherein the one or more light sources are light emitting diodes.

* * * * *